US007374491B1

(12) United States Patent
Johnson

(10) Patent No.: US 7,374,491 B1
(45) Date of Patent: May 20, 2008

(54) GAMING MACHINE WITH SPACE EFFICIENT CONFIGURATION AND MULTIPLE PIN DECK LATCH AND INTUITIVE TICKET REDEMPTION SYSTEM

(75) Inventor: Richard Johnson, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 779 days.

(21) Appl. No.: 10/243,890

(22) Filed: Sep. 13, 2002

(51) Int. Cl.
*A63F 9/24* (2006.01)

(52) U.S. Cl. ..... 463/46

(58) Field of Classification Search ..... 463/1–69, 463/143 R, 138.2; 49/319; 493/137
See application file for complete search history.

(56) References Cited

U.S. PATENT DOCUMENTS 4,398,723 A 8/1983 Erickson et al.
4,440,457 A * 4/1984 Fogelman et al. ..... 463/46
4,614,342 A 9/1986 Takashima
D311,428 S 10/1990 Sears
D316,117 S 4/1991 Irwin
D319,077 S 8/1991 Arato et al.
5,114,157 A 5/1992 Kita
5,324,036 A * 6/1994 Morrow ..... 463/47
5,456,468 A 10/1995 Stringfellow et al.
5,676,231 A 10/1997 Legras et al.
D386,883 S 11/1997 Do et al.
5,683,082 A 11/1997 Takemoto et al.
5,799,767 A 9/1998 Molbak
5,813,914 A 9/1998 McKay et al.
5,848,932 A 12/1998 Adams
5,857,910 A 1/1999 Watanabe et al.
5,967,287 A 10/1999 Cole
6,019,207 A 2/2000 Cole
6,019,369 A 2/2000 Nakagawa et al.
6,117,010 A 9/2000 Canterbury et al.
6,138,814 A 10/2000 Miller et al.
6,173,955 B1 1/2001 Perrie et al.
6,201,532 B1 3/2001 Tode et al.
D447,312 S 8/2001 Swaine
6,270,411 B1 8/2001 Gura et al.
6,305,686 B1 10/2001 Perrie et al.
D451,145 S 11/2001 Taxon
6,315,660 B1 11/2001 DeMar et al.
6,334,612 B1 1/2002 Wurz et al.

(Continued)

*Primary Examiner*—Ronald Laneau
*Assistant Examiner*—Emmanuel Omotosho
(74) *Attorney, Agent, or Firm*—Andrew B. Chen, Esq.; Brooke W. Quist, Esq.; J. P. Cody, Esq.

(57) ABSTRACT

A gaming machine includes a video display and gaming controls fixed within the machine so that the surfaces of the display and controls are at an angle that provides enhanced ergonomics and increased interior space within the gaming machine. A hopper with a tall and narrow shape stores a large number of coins while increasing interior space. A video connection system allows a video cable to connect the video display and PC of the gaming machine without the cable being substantially bent, thereby increasing interior space. Multiple heat dispensing devices and a vent having fins directed inward and upward into the machine efficiently dispense heat from within the gaming machine while allowing the rear of machine to be placed very close to another surface. A multiple pin deck latch mechanism reduces wobbling when the deck is closed. Also, redemption tickets are dispensed into the same receptacle as coins are dispensed.

4 Claims, 6 Drawing Sheets

U.S. PATENT DOCUMENTS

| | | | | |
|---|---|---|---|---|
| 6,334,814 | B1 | 1/2002 | Adams | |
| 6,340,158 | B2 | 1/2002 | Pierce et al. | |
| 6,358,146 | B1 | 3/2002 | Adams | |
| 6,358,147 | B1 | 3/2002 | Jaffe et al. | |
| 6,398,219 | B1 | 6/2002 | Pierce et al. | |
| 6,688,984 | B2 * | 2/2004 | Cole | 463/46 |
| 2002/0022509 | A1 | 2/2002 | Nicastro, II et al. | |
| 2004/0013489 | A1 * | 1/2004 | Hansen et al. | 410/77 |

* cited by examiner

GAMING MACHINE WITH SPACE EFFICIENT CONFIGURATION AND MULTIPLE PIN DECK LATCH AND INTUITIVE TICKET REDEMPTION SYSTEM

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

The present invention relates generally to improvements in gaming machines and, more particularly, to a new gaming machine design that provides for improved ergonomics, improved placement and accessibility of internal components, a more stable deck latch system, and a more intuitive ticket redemption system.

Because casino gaming establishments have limited floor space, gaming machines that under perform are quickly removed from the gaming floor. Consequently, gaming machines, such as slant-top gaming machines, are consistently in need of technological enhancements that allow them to provide a gaming experience that effectively attracts new players and maintains player interest. To provide such enhancements, generally more system components must be placed within the gaming machine housing. For example, gaming machines typically include one or even two full size PCs to control and enhance the gaming experience. However, since space on the gaming floor is limited, it is desirable for the overall size and footprint of a gaming machine not to increase even though new system components are added internally.

Providing a satisfying gaming experience also involves the minimization of player distractions. In many slant-top gaming machines, the main panel, or deck, covering the top surface of the game and that surrounds the display screen and game control components, is conventionally secured to the gaming machine through a hinge at the top of the panel and a latch at the bottom of the panel. This manner of securing the deck to the gaming machine allows the deck to sometimes wobble when a player exerts pressure on the deck, e.g., when the player rests his or her hands on the deck. Such wobbling is distracting to the player and diminishes the level of satisfaction with the gaming experience.

There is thus a need for a slant-top gaming machine which allows additional components that enhance the gaming experience to be added to the interior of the machine without increasing the overall size or footprint of the machine. Also, there is a need for a slant-top gaming machine which has a deck secured in a manner that prevents wobbling.

BRIEF SUMMARY OF THE INVENTION

The above needs are achieved by a gaming machine having a configuration and internal components that maximize space within the machine. Also, the gaming machine has a multiple pin deck latch mechanism that prevents wobbling when the deck is closed.

For example, the gaming machine of the present invention may be housed within a cabinet with a base and include a video display and gaming controls fixed inside the machine such that the surfaces of the video display and gaming controls reside at an angle with respect to the base, wherein the angle is chosen so as to provide enhanced ergonomics and more interior room as compared with conventional gaming machines.

The gaming machine of the present invention may also include an improved hopper assembly with a tall and narrow shape. The gaming machine of the present invention includes a receptacle for storing coins to be dispensed to a player upon a payout condition, wherein the width of the receptacle is not greater than about two thirds of the height of the receptacle, and wherein the depth of the receptacle is not greater than about two thirds of the height of the receptacle. This shape allows the improved hopper, e.g., receptacle, to store as many coins as a conventional hopper, while providing more space within the machine for other components.

The gaming machine in accordance with the present invention also may include an improved video connection system. The improved video connection system may include a first video connector and a second video connector, each of which has a video connection interface. The improved video connection system may also include a connection linking the first video connector and the second video connector such that a video signal can pass between the video connectors. The improved video connection system may also include an enclosure in which the first video connector, the second video connector, and the connection are fixed such that the interface of the first video connector and the interface of the second video connector face a similar direction such that, when the first video connector is attached to the computer, a video cable connecting the second video connector and the video display does not substantially bend near the location at which the video cable is connected to the second video connector.

A gaming machine of the present invention with this improved video connection system is advantageous in that the improved video connection system allows the video display and PC of the gaming machine of the present invention to be connected via a video cable without the cable having to be substantially bent near the PC. Unlike conventional gaming machines, which must provide a space to allow for a substantial bend in the video cable connecting the PC and video display, the gaming machine of the present invention need not provide such a space and therefore allows for more internal room for other components.

The gaming machine of the present invention also may include one or more heat dispensing devices that move heat out of the machine through a vent on the rear surface of the cabinet, wherein the vent has at least one opening and at least one fin corresponding to the at least one opening, and wherein the at least one fin is directed inward and upward relative to the rear surface of the cabinet. The inward direction of the at least one fin allows heat to be forced out of the gaming machine even when the machine is placed very close to another machine in a back-to-back position. Consequently, more gaming machines of the present invention may be placed on a gaming floor as compared with conventional machines which cannot be placed as closely together in a back-to-back position.

The gaming machine of the present invention includes other improvements in addition to those that provide more internal room and allow closer back-to-back positioning. For example, the gaming machine of the present invention may include a deck with an improved connection mechanism that prevents wobbling when the deck is closed. The gaming machine, in accordance with the present invention, may include a deck, or first panel, attached at a first end of the first panel to the gaming machine by a hinge such that the first panel swings open or closed about the hinge, and wherein the first panel has at least two pins attached to the underside of the first panel near a second end of the first panel parallel to the first end. The gaming machine of the present invention may also include a second panel fixed to the gaming machine, wherein the second panel has at least two means for catching pins, wherein, when the first panel is closed, the at least two pins on the underside of the first panel are caught by the at least two means for catching pins thereby securing the second end of the first panel to the second fixed panel.

The gaming machine of the present invention may also include an improved redemption ticket system that dispenses redemption tickets to a location that players expect to receive payouts, e.g., the coin payout tray. The gaming machine in accordance with the present invention may include a receptacle into which coins are dispensed to a player. The gaming machine of the present invention may also include an opening in the receptacle through which paper tickets can be dispensed to the player. Also, the gaming machine of the present invention may include a ticket printer that dispenses tickets into the receptacle through the opening.

The gaming machine of the present invention may also include an improved paper bill/paper ticket acceptor. Conventional paper bill/paper ticket acceptors used with slant top gaming machines require paper bills or paper tickets to be inserted at an angle, which is difficult for a player seated in front of the gaming machine. The gaming machine of the present invention includes a means for receiving paper bills or paper tickets that are inserted in the means at a direction substantially parallel with the base of the machine. By allowing such a manner of paper ticket or paper bill insertion, the gaming machine of the present invention is more ergonomic and consequently provides a more pleasurable gaming experience for the player.

BRIEF DESCRIPTION OF THE DRAWINGS

The present invention is illustrated in the figures of the accompanying drawings which are meant to be exemplary and not limiting, in which like references are intended to refer to like or corresponding parts, and in which.

DETAILED DESCRIPTION OF THE PREFERRED EMBODIMENTS

The preferred embodiments of a gaming machine in accordance with the present invention is described with reference to the drawings in FIGS. 1-10.

Figure 1:
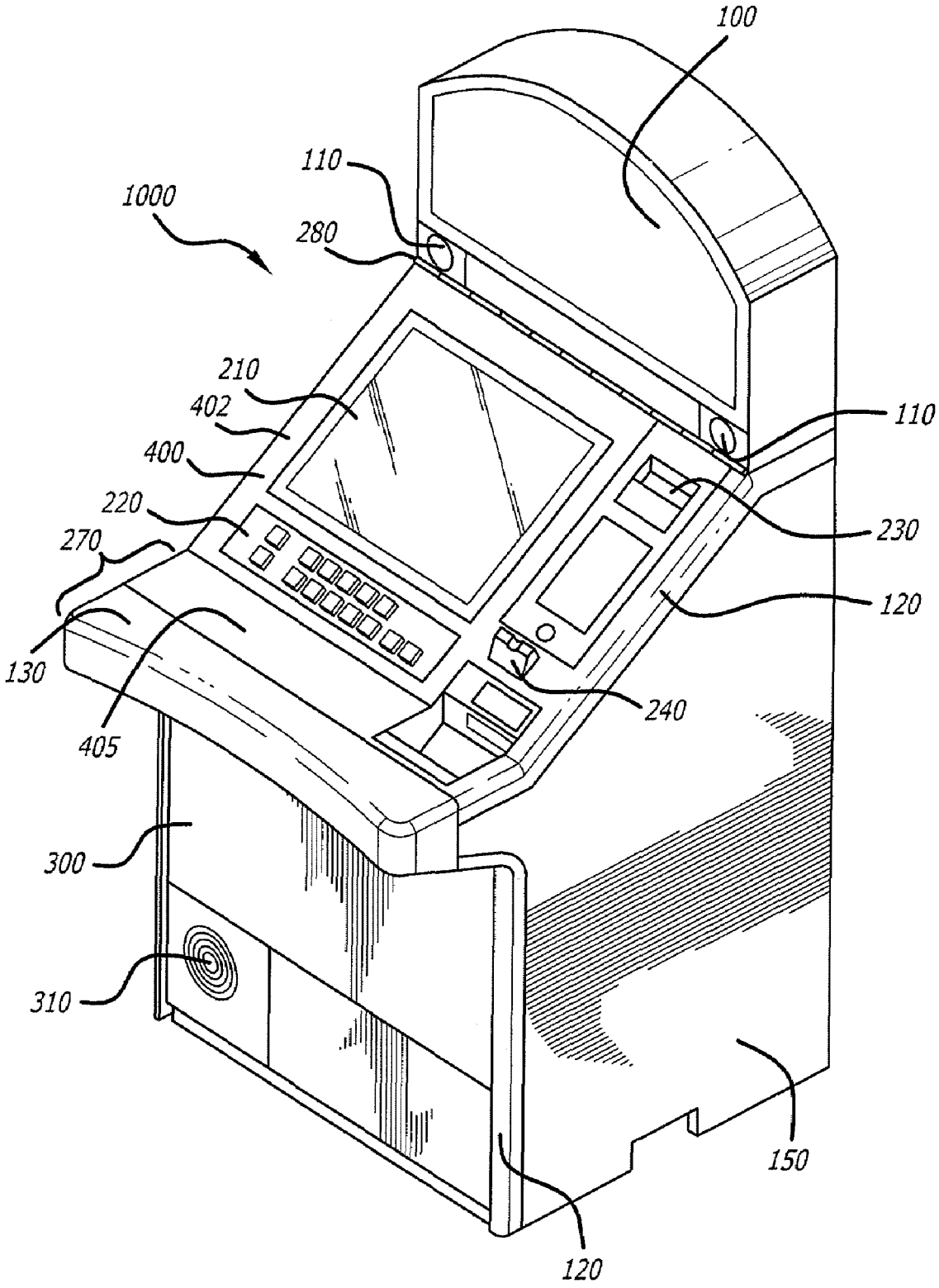
FIG. 1 is a perspective view of the exterior of an embodiment of the gaming machine of the present invention.

FIG. 1 is a perspective view of the exterior of an embodiment of the gaming machine of the present invention. The gaming machine 1000 may include a cabinet 150 that houses the internal system components of the machine and a top box 100 providing a display area. Top box 100 may include audio speakers 110 at either end of the top box and at ear level of a player seated in front of the machine 1000. The bottom of the gaming machine 1000 may include an access door 300 which allows access to internal components. An additional speaker 310 may be located at the bottom of the access door 300 to emphasize bass elements of the audio. At the edges of the cabinet 150 are molded urethane trim 120 and a molded urethane player armrest 130 which soften the edges of the cabinet for a more appealing look and touch.

The gaming machine 1000 may be configured as a slant-top, where the display, gaming controls, and some player interactive components of the machine are positioned at a slant. For example, as shown in FIG. 1, the gaming machine 1000 may include a display 210, game control buttons 220, a bill accepter 230, and a coin entry 240, all of which may be positioned at an angle with respect to a flat armrest 270 extending from the cabinet 150. A coin payout/coin return tray 250 may be positioned within the armrest 270.

As shown in FIG. 1, a panel 400, which may also be referred to as a deck, may be used to cover the display, gaming controls, some player interactive components, and the top of the armrest 270. The deck 400 may be structured as a single panel comprising two sections meeting at an angle. The deck 400 may comprise a shorter bottom section 405 that covers the top of the flat armrest 270 and a larger top section 402 that surrounds the display screen, gaming controls, and some player interactive components. The deck 400 may be secured to the cabinet 150 by a hinge 280 at the top of the deck 400 and deck latch at the bottom of the deck (not shown).

It should be noted that the single piece construction of deck 400 of the gaming machine 1000 of the present invention is an improvement over conventional decks. Conventional decks used with slant top gaming machines generally are constructed of two pieces connected by an adhesive and require that a laminate finish be placed over the two piece deck using an adhesive. By contrast, the one piece deck 400 of the gaming machine 1000 of the present invention is cheaper to manufacture and structurally more reliable than the two piece conventional decks. Also, the one piece deck 400 can easily be finished, e.g., by painting, and does not require a cumbersome adhesive laminate finish as with conventional two piece decks.

Figure 2:
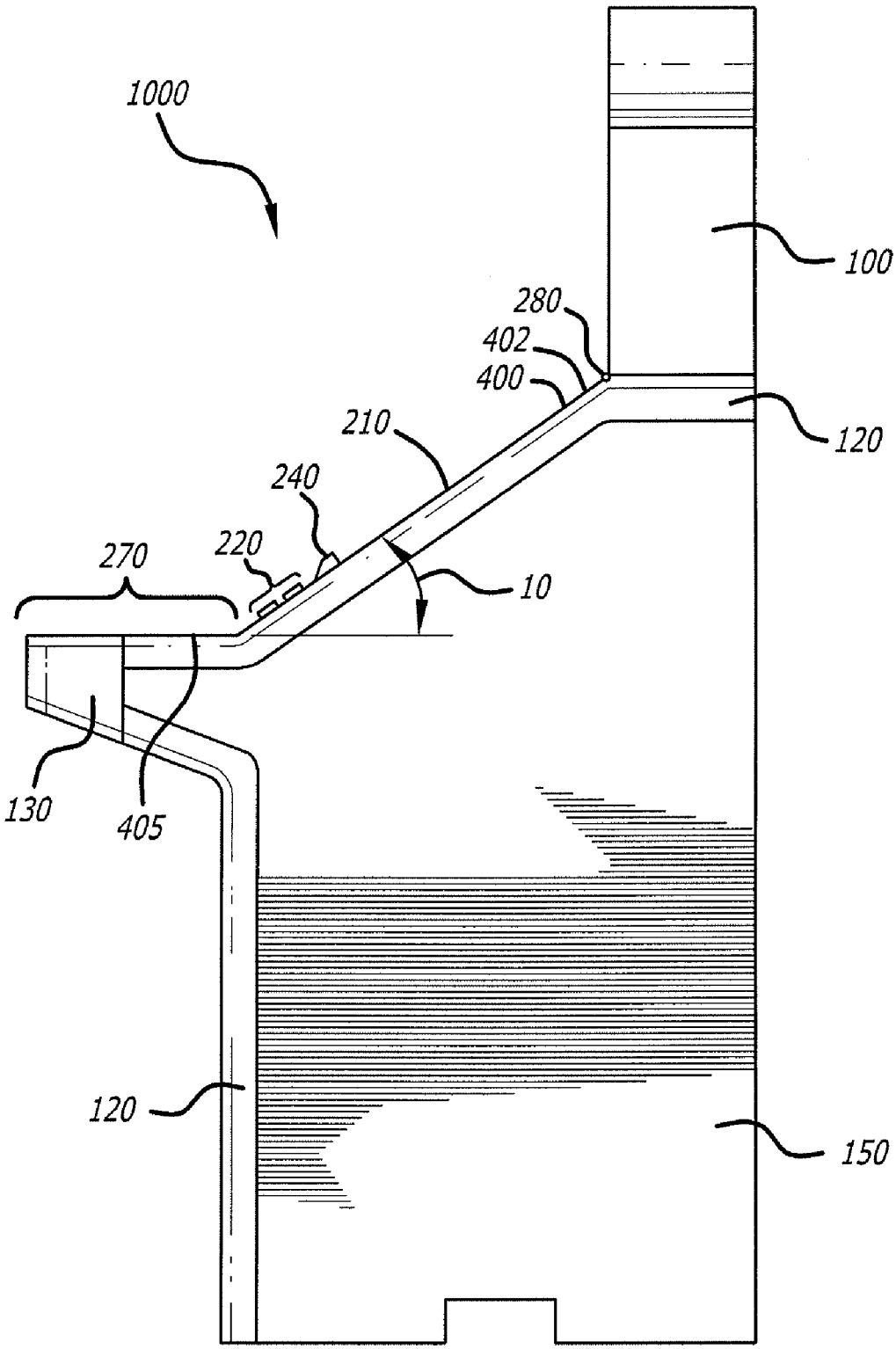
FIG. 2 is a side view of the exterior an embodiment of the gaming machine of the present invention.

FIG. 2 is a side view of the exterior of the gaming machine 1000. As described above, the display 210, game control buttons 220, and other player interactive components, such as coin entry 240, are positioned at an angle 10 with respect to the horizontal armrest 270. Generally, the armrest 270 is substantially parallel to the base of the cabinet 150. Also, the two sections of the deck 400, top portion 402 and bottom portion 405, meet at the same angle 10. Angle 10 is generally greater than 28 degrees and preferably about 35 degrees.

The inventor has found that an angle of about 35 degrees provides an optimal balance of ergonomics and space for internal components. For example, as compared with a conventional gaming machine having the display and gaming controls on a relatively flat surface, the gaming machine 1000 of the present invention having an angle of about 35 degrees results in a more ergonomic machine where the player seated in front of the machine can more easily view the display with less glare and can more easily reach the game controls and other interactive components, e.g., the bill acceptor and coin entry. Also, as compared with a relatively flat surface, an angle of about 35 degrees provides more space within the cabinet for internal components without increasing the footprint of the gaming machine. Furthermore, the angle of about 35 degrees allows for internal components of gaming machine 1000 to be placed closer to the front of the machine which makes those internal components easier to access and easier to service as compared with internal components of machines with relatively flat surfaces.

In addition to increasing the angle of the deck and the angle at which components such as the display and gaming controls are positioned, another technique for increasing the amount of space within the gaming machine cabinet is to utilize internal components designed to conserve space. Examples of such space efficient components can be described with reference to FIG. 3, which provides a perspective view of the interior of the gaming machine 1000.

One space efficient component that may be used in gaming machine 1000 is an improved hopper assembly 500. Hoppers, which store coins used for payouts (e.g., when a player wins a game) and coins deposited by players, conventionally are structured as wide and deep receptacles. These hoppers allow a large number of coins to be stored, but the large width and depth of such hoppers limits the space available for other internal components. The hopper 500 of the present invention has a tall and slender shape such that neither the width nor the depth of the hopper is greater than, for example, about two thirds of the hopper's height. The tall and slender shape of the hopper 500 allows it to store as many coins as a conventionally shaped hopper, but in a much thinner and narrower space, thereby allowing more room for other internal system components.

Figure 3:
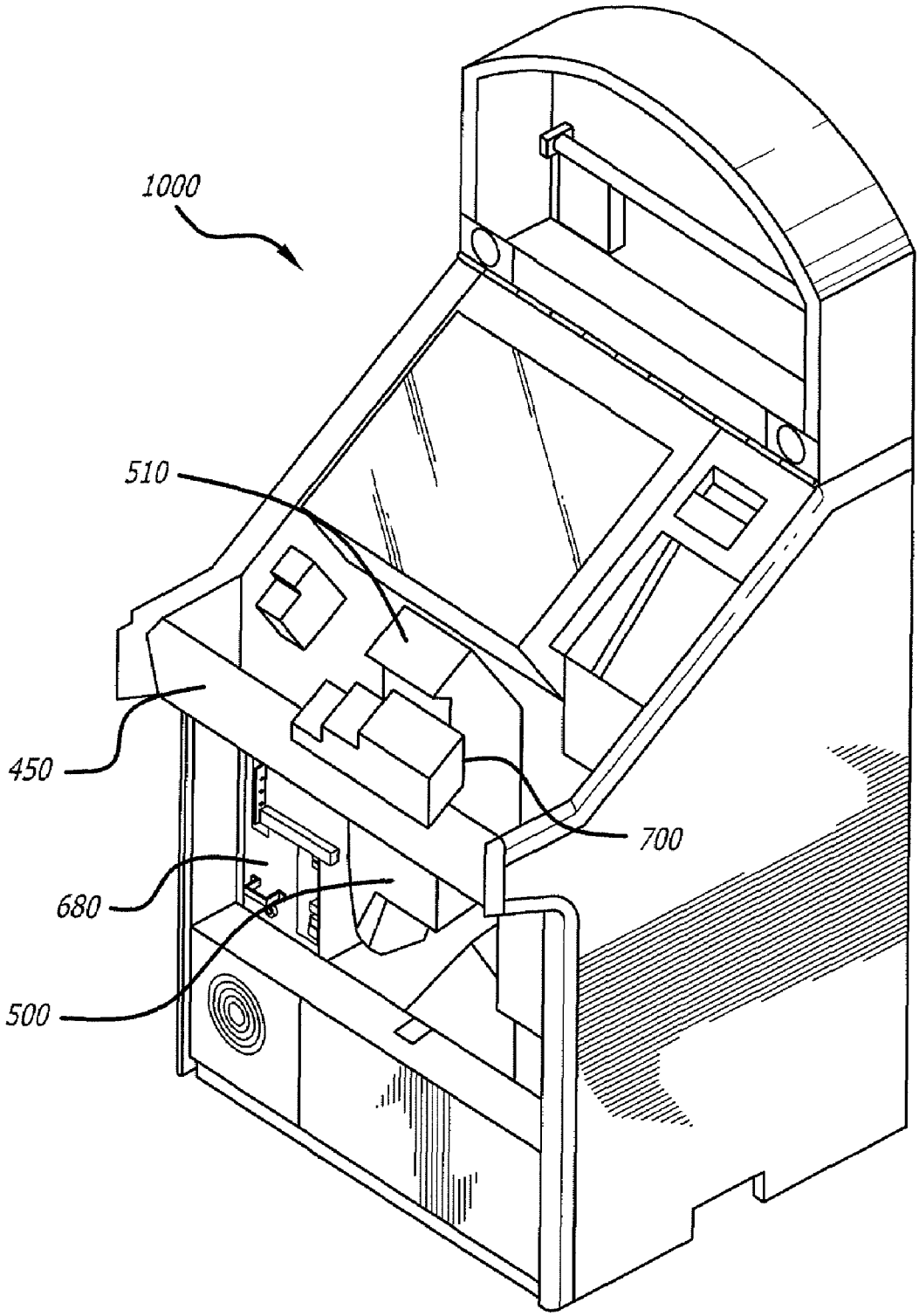
FIG. 3 is a perspective view of the interior of an embodiment of the gaming machine of the present invention.

To conserve space, it may be desirable to install other system components in a gaming machine at a position above or in front of the hopper. However, such positioning of other components decreases the accessibility of the hopper and increases the difficulty for an attendant to fill the hopper with coins. In an embodiment of the present invention, this problem may be alleviated by attaching a hopper fill chute 510 to the hopper 500. As shown in FIG. 3, the hopper fill chute 510 may be attached to the top of the hopper 500 at an angle to provide an easy access pathway to the hopper 500 that circumvents other components, such as, for example, the ticket printer 700, installed at a position that would otherwise block access to the hopper 500.

Another space efficient component that may be used in gaming machine 1000 is an improved video connection system. Standard, full-size PCs are often used in gaming machines to control gaming as well as other functions. Typically, PCs are installed in gaming machines such that the rear section of the PC on which the video connector is located faces the front of the gaming machine. For example, as shown in FIG. 3, the gaming machine 1000 includes a PC assembly 680 the rear of which faces the front of the gaming machine 1000.

Figure 4:
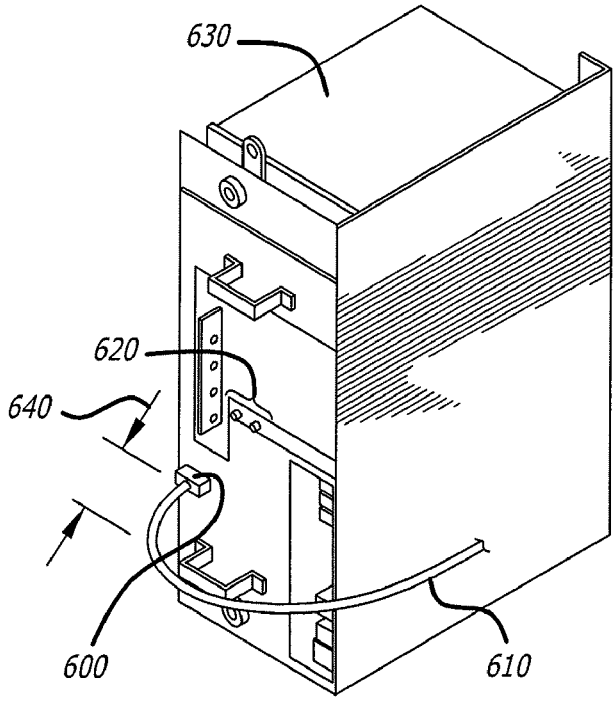
FIG. 4 (Prior Art)
FIG. 4 is a perspective view of the rear section of a standard PC and a conventional video connection system.

FIG. 4 is a perspective view of the rear section of a standard PC and a conventional video connection system. As shown in FIG. 4, the video connector 600 of one end of a conventional video cable 610 is attached to the video connector 620 on the rear section of a standard PC 630 and the other end of the video cable 610 is attached to the display of the gaming machine. As shown in FIG. 4, the video cable 610 must be bent and reversed in direction in order to connect the PC to the display of the gaming machine. To accommodate the video connector 600 and the bend of the video cable 610, a gap 640 of at least several inches must be left between the rear of the PC and the back of the access door of the gaming machine. This gap results in wasted space that could otherwise be used for the placement of additional components with the gaming machine.

Figure 5:
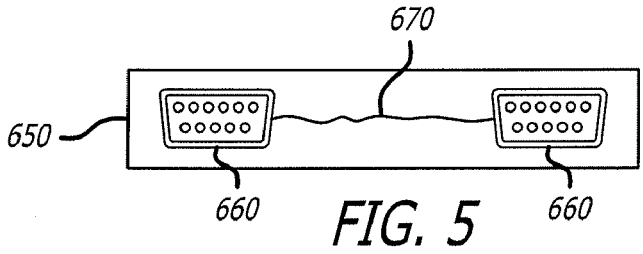
FIG. 5 is a front view of an improved video connection system that may be used with an embodiment of the gaming machine of the present invention.

FIG. 5 is a front view of an improved video connection system 650 that allows for a more efficient use of space. The video connection system 650 allows a conventional video cable to be connected to the PC of gaming machine 1000 without requiring the video cable to be substantially bent or reversed in direction. As shown in FIG. 5, the video connection system 650 may include at least two video connectors 660 whose interfaces face a similar direction and that are linked together by a connection 670 such that a video signal, such as generated by a PC, may flow between the connectors 660 without substantial degradation. For example, connection 670 may comprise a standard video ribbon cable. The connectors 660 and connection 670 may be enclosed in a shielding, such as, for example, a metal casing, to prevent substantial interference with the video signal passing between the connectors.

Figure 6:
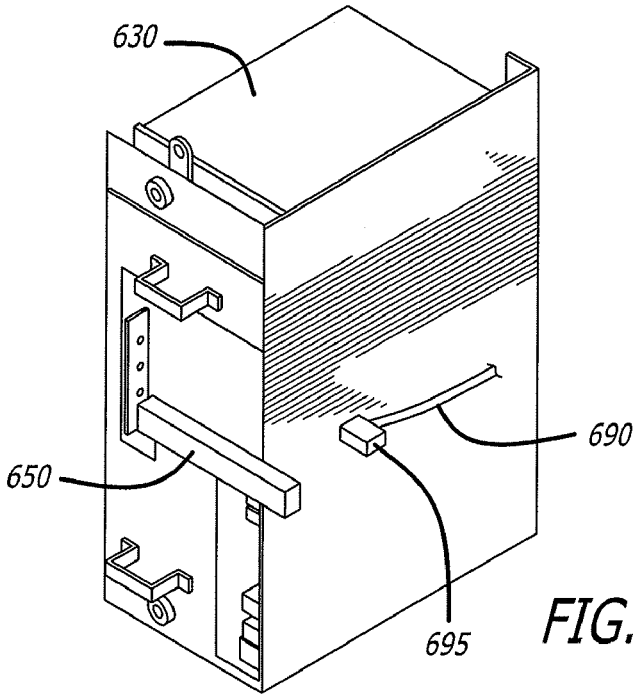
FIG. 6 is a perspective view of the rear section of a PC in an embodiment of the gaming machine of the present invention on which the improved video connection system is used.

FIG. 6 is a perspective view of the rear section of PC 680 within gaming machine 1000 on which the improved video connection system 650 is used. Although not visible in FIG. 6, PC 680 has a video connector on its rear section in a similar location to that of standard PC 630 of FIG. 4. Returning to FIG. 6, the improved video connection system 650 is shown in a rear view (so that the video connectors 660 are not visible) with a first video connector 660 attached to the video connector (not visible) on the rear section of PC 680. The second video connector 660 of the improved video connection system 650 faces the front of the PC 680 and the interior of gaming machine 1000. The video connector 695 of a first end of a conventional video cable 690 may be connected to the second video connector 660 of the improved video connection system 650 and the second end of the cable 690 may be connected to the display 210 of the gaming machine 1000 (not shown). As shown in FIG. 6, the improved video connection system 650 allows a conventional video cable 690 to connect PC 680 with the display 210 of the gaming machine 1000 without requiring the cable 690 to be substantially bent near the connector 660 through which the cable 690 is attached to the improved video connection system 650. Consequently, no gap need be maintained between access door 300 and the rear of the PC 680. Therefore, the rear of the PC 680 can be positioned flush with the back of access door 300, thereby providing more space within the gaming machine 1000 for additional system components.

It should be noted that although FIG. 5 shows the interfaces of connectors 660 facing the same direction, this is not required. The direction of the interface of one connector 660 need only be similar to the direction of the interface of the other connector 660 so that a video cable connecting a display to a standard PC through the connection system 650 does not substantially bend near the connector 660 through which the video cable is connected to the connection system 650.

The features of the present invention described above increase space within a gaming machine so that additional components may be accommodated within the machine without increasing the overall size and footprint of the machine. Limiting the size and footprint of gaming machines is important to gaming establishments so that they can maximize the number of gaming machines that are placed on the gaming floor.

In addition, efficient positioning of gaming machines can also help to maximize the number of machines that can be placed on the gaming floor. For example, gaming establishments generally place rows of gaming machines back-to-back on the gaming floor. However, since gaming machines often dissipate heat from within their cabinets through vents at the rear of the machines, often a gap must be maintained between machines placed back-to-back in order to allow for proper heat dissipation.

In an embodiment of the present invention, a multiple fan and venting system is used to efficiently dissipate heat from within the gaming machine 1000 while allowing the gaming machine 1000 to be placed back-to-back against another machine without any substantial gap between the gaming machine 1000 and the other machine. The multiple fan and venting system includes two or more fans positioned inside the gaming machine 1000 near heat sources so as to be able to draw heat away from those sources. For example, in the gaming machine 1000, a fan may be positioned near the power supply of the PC 680 and another fan may be positioned near the display 210.

Figure 7:
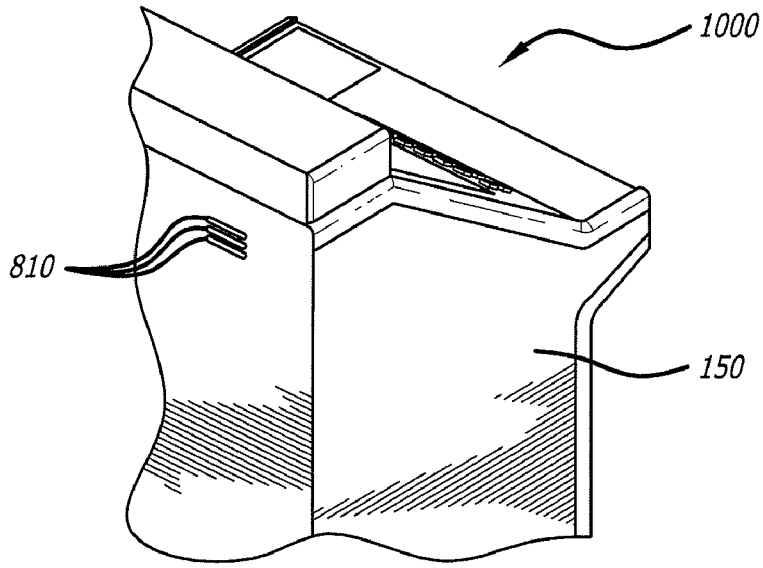
FIG. 7 is a perspective view of the rear of an embodiment of the gaming machine of the present invention.

FIG. 7 is a perspective view of the rear of the gaming machine 1000 of the present invention. As shown in FIG. 7, a vent comprising one or more openings 810 that allow heat to dissipate from within the gaming machine 1000 may be located on the rear of cabinet 150 at a height that positions the vent near the rear of display 210, a significant heat source.

Figure 8:
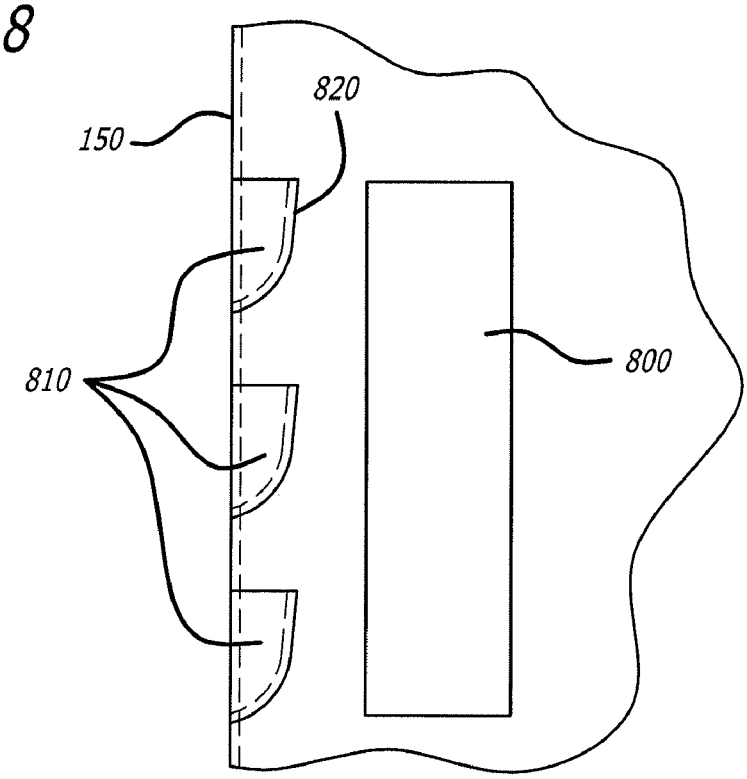
FIG. 8 is a cut-away view of the interior of an embodiment of the gaming machine of the present invention.

FIG. 8 is a cut-away view of the interior of the gaming machine 1000 from the perspective of the side of the machine near the openings 810 of the vent. A fan 800 draws heat from the nearby display 210 (not shown) and from elsewhere within the gaming machine 1000 and forces the heat out the openings 810 of the vent. As shown in FIG. 8, the fins 820 of the vent corresponding to the openings 810 are attached to the back wall of cabinet 150 and these fins 820 turn inward and upward. Because the fins 820 turn inward, the openings 810 remain essentially unblocked even when the rear of the gaming machine 1000 is placed very closely up against another surface. Thus, the inward positioning of the fins 820 allows heat to exit the openings 810 even when the gaming machine 1000 is placed very close to a wall or very close to another machine in a back-to-back position. Also, the upward positioning of the fins 820 prevents liquids, e.g., from beverages placed on top of the machine, from entering the inside of the machine through openings 810.

Other embodiments of the gaming machine 1000 of the present invention include improvements in addition to those that increase internal space and that allow for closer back-to-back positioning, as described above. In conventional slant-top gaming machines, the deck that covers the top surface of the machine and that surrounds the display screen and game control components is attached to the machine in a manner that allows the deck to wobble when the player exerts pressure on the deck. This wobbling is a distraction and diminishes the player's satisfaction with the game.

An embodiment of the gaming machine 1000 of the present invention includes a deck with an improved connection mechanism that minimizes wobble. As described previously in reference to FIG. 1, deck 400 may be secured to the cabinet 150 at the top of the deck by a hinge 280. This allows the deck 400 to swing up from hinge 280 so that internal components of the gaming machine 1000, e.g., the hopper fill chute 510, may be accessed. Deck 400 closes by swinging down from hinge 280 and locking at its bottom to a deck latch. This deck latch resides on a fixed panel 450 inside cabinet 150 within the armrest section, as shown in FIG. 3. The deck latch resides on the rear side (facing the interior of gaming machine 1000) of fixed panel 450 and is not visible in FIG. 3.

Figure 9:
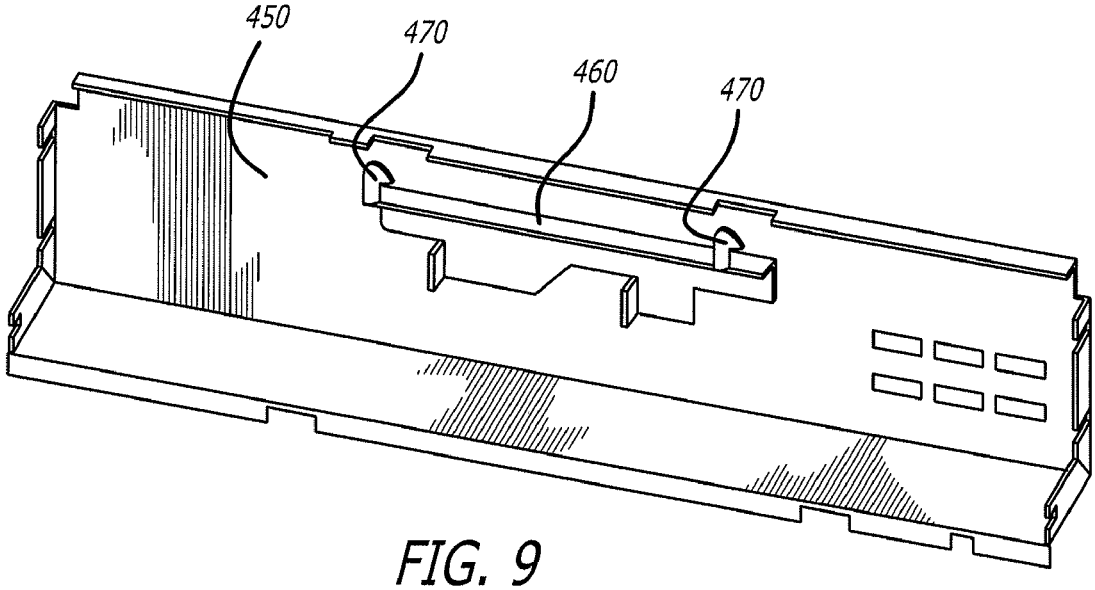
FIG. 9 is a perspective view of the rear side of a fixed panel of an embodiment of the gaming machine of the present invention.

FIG. 9 is a perspective view of the rear side of fixed panel 450 (e.g., the side facing the interior of cabinet 150) showing the deck latch 460. The deck latch 460 comprises a bar with two hooks 470 at the ends of the bar that catch two pins on the underside of deck 400.

Figure 10:
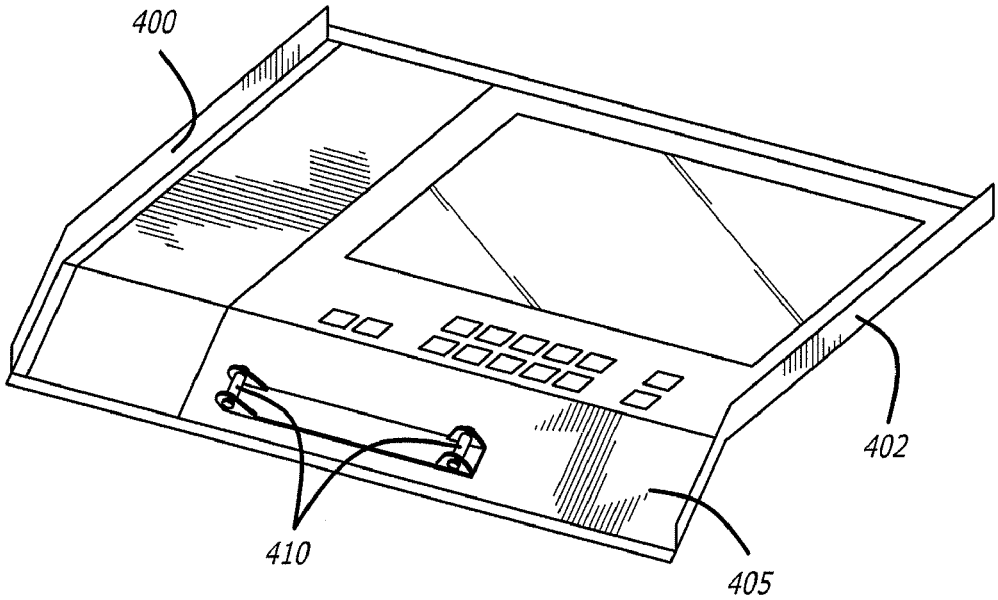
FIG. 10 is an inverted view of a deck of an embodiment of the gaming machine of the present invention.

FIG. 10 is an underside (inverted) view of deck 400 showing the two pins 410 spaced apart from each other on the underside of the bottom portion 405 of deck 400. When the deck 400 is closed, the two pins 410 rest on the bar of the deck latch 460. The bar can then be moved horizontally in one direction so that the hooks 470 fixed to the bar catch and hold the pins 410. The bar can be moved in the opposite direction to release the pins 410 from the hooks 470 so that the deck 400 may be opened. With the two pins 410 secured to the bar of the deck latch 460 in this manner, the deck 400 is prevented from wobbling when closed.

It should be noted that the hooks 470 on latch 460 and the pins 410 on the underside of deck 400 need not be spaced apart any particular distance, but rather need only be spaced apart sufficiently such that when the deck 400 closes, the two pins 410 are supported by hooks 470 and the bar of latch 460 such that substantial wobbling is prevented.

Another embodiment of the present invention includes an improved redemption ticket system. Traditionally, payouts from gaming machines have been made in coins, and as such, gaming machines generally are manufactured to include components for making coin payouts, e.g., coin hoppers and coin payout trays. More recently, redemption tickets have become desirable for use in making payouts as an alternative to or in addition to coins. Thus, it is desirable to design gaming machines to include the function of making redemption ticket payouts at the time of initial manufacture or to design them to allow for this function to be easily added at a later time. For example, where a gaming machine will not include a redemption ticket printer at the time of initial manufacture, an opening through which tickets may be dispensed is still made in the gaming machine cabinet and space is set aside within the cabinet so that a redemption ticket printer may be easily added at a later time.

Conventional gaming machines are designed to include, at the time of initial manufacture or later on, a ticket redemption system that is independent of the coin payout system. For example, in conventional gaming machines, coin payouts are made to a coin payout tray and redemption ticket payouts are made to a different location. For instance, in conventional gaming machines the coin payout tray may be at the right side of the machine whereas redemption tickets may be output from the left side of the machine.

Such independence of the ticket redemption system from the coin payout system has several drawbacks. First, players are accustomed to receiving payouts in the coin payout tray and conventional gaming machine designs that force a player to look in another location for ticket payouts are distracting and reduce the player's level of satisfaction with the gaming experience.

Second, to minimize this distraction, conventional gaming machine designs generally position the opening through which redemption tickets are dispensed in a location that is readily visible to the player. Since gaming establishments generally require that there be no accessible openings to the inside of gaming machines, non-functional openings, such as the ticket opening in a gaming machine that does not have a redemption ticket printer installed, must be covered, such as by a plate. As the ticket opening in conventional gaming machines is positioned in a location that is readily visible, a plate covering such an opening is also readily visible and reduces the aesthetic qualities of the machine.

An embodiment of the present invention includes an improved redemption ticket system that overcomes the aforementioned disadvantages. As shown in FIG. 1, the coin payout tray 250 is located at the right side of gaming machine 1000 within armrest 270. In gaming machine 1000, the opening 260 through which redemption tickets are dispensed is located within the coin payout tray 250. As shown in FIG. 3, the redemption ticket printer 700 in gaming machine 1000 is located near the position of coin payout tray 250 so that redemption tickets can easily be dispensed through opening 260 into the coin payout tray 250.

Thus, gaming machine 1000 reduces player distraction by dispensing redemption tickets into a location at which players are accustomed to receiving payouts. Also, although gaming machine 1000 is designed so that tickets come out in a familiar location, the opening 260 itself, since it is located inside of coin payout tray 250, is not readily visible. Consequently, where a redemption ticket printer is not used with gaming machine 1000, any plate covering opening 260 is also not readily visible and therefore does not negatively impact the appearance of the machine.

Another embodiment of the gaming machine 1000 of the present invention includes an improved bill/paper ticket acceptor 230, as shown in FIG. 1. Convention bill/paper ticket acceptors used with slant top gaming machines require that paper bills or tickets be inserted at an angle. Such an angular insertion method is difficult for a player seated at the machine to perform and reduces the satisfaction level of the player's gaming experience. The improved bill/paper ticket acceptor 230 of gaming machine 1000 allows bills or paper tickets to be inserted horizontally, e.g., substantially parallel with the base of the gaming machine 1000. Thus, the improved bill/paper ticket acceptor 230 of gaming machine 1000 is more ergonomic and provides a more satisfying gaming experience for a player as compared to bill/paper acceptors of conventional gaming machines.

While the invention has been described and illustrated in connection with preferred embodiments, many variations and modifications as will be evident to those skilled in this art may be made without departing from the spirit and scope of the invention, and the invention is thus not to be limited to the precise details of methodology or construction set forth above as such variations and modification are intended to be included within the scope of the invention.

What is claimed is:

1. A gaming machine comprising:

a first panel having a first end opposite a second end, wherein the first panel is attached at a first end of the first panel to the gaming machine by a hinge such that the first panel swings open or closed about the hinge;

an elongate bracket coupled to the underside of the first panel, wherein the elongate bracket includes a first end and a second end;

a first pin coupled to the first end of the elongate bracket and a second pin coupled to the second pin coupled to the second end of the elongate bracket, wherein the first and second pins are not in direct contact with the underside of the first panel, and wherein the first and second pins are parallel to the underside of the first panel;

a second panel coupled to the gaming machine, wherein a first edge of the second panel abuts the first end of the first panel in a closed position; and a bar slidably coupled to an inner surface of the second panel such that the bar moves horizontally in one direction, wherein the bar includes a first hook coupled to a first end of the bar and a second hook coupled to a second end of the bar, wherein the first hook and the second hook are oriented in a same direction, and wherein the first hook and second hook engage the first pin and the second pin to prevent substantial wobbling of the first panel in a closed position.

2. A gaming machine comprising:

a first panel having a first end opposite a second end, wherein the first panel is attached at a first end of the first panel to the gaming machine by a hinge such that the first panel swings open or closed about the hinge;

at least two pins attached to the underside of the first panel via a bracket, wherein the at least two pins are mounted substantially parallel to the underside of the first panel, and wherein the at least two pins are not in direct contact with the underside of the first panel; and a second panel fixed to the gaming machine, wherein the second panel has a bar slidably coupled to the second panel, wherein the bar includes at least two hooks fixed to the bar, wherein the hooks are oriented in the same direction, and wherein the hooks are movable in a horizontal direction relative to the surface of the second panel, and wherein, when the first panel is closed, the at least two pins on the underside of the first panel are caught by the at least two hooks thereby securing the second end of the first panel to the second fixed panel to prevent substantial wobbling of the first panel in a closed position.

3. The gaming machine of claim 2, wherein the gaming machine is a slant top gaming machine.

4. The gaming machine of claim 1, wherein the bracket is U-shaped.

* * * * *